US010384335B2

(12) United States Patent
Ricordi

(10) Patent No.: US 10,384,335 B2
(45) Date of Patent: Aug. 20, 2019

(54) GAS FASTENING TOOL WITH RE-INJECTED AIR

(71) Applicant: ILLINOIS TOOL WORKS INC., Glenview, IL (US)

(72) Inventor: Christian Ricordi, Bourg les Valence (FR)

(73) Assignee: ILLINOIS TOOL WORKS INC., Glenview, IL (US)

( * ) Notice: Subject to any disclaimer, the term of this patent is extended or adjusted under 35 U.S.C. 154(b) by 614 days.

(21) Appl. No.: 14/760,233

(22) PCT Filed: Dec. 26, 2013

(86) PCT No.: PCT/US2013/077833
§ 371 (c)(1),
(2) Date: Jul. 10, 2015

(87) PCT Pub. No.: WO2014/113200
PCT Pub. Date: Jul. 24, 2014

(65) Prior Publication Data

US 2015/0360360 A1 Dec. 17, 2015

(30) Foreign Application Priority Data

Jan. 16, 2013 (FR) ..... 13 50361

(51) Int. Cl.
*B25C 1/00* (2006.01)
*B25C 1/08* (2006.01)

(52) U.S. Cl.
CPC ..... *B25C 1/08* (2013.01)

(58) Field of Classification Search
CPC ..... B25C 1/08
(Continued)

(56) References Cited

U.S. PATENT DOCUMENTS 5,090,606 A * 2/1992 Torii ..... B25C 1/08 123/46 SC
6,932,031 B2 * 8/2005 Adams ..... F02B 71/00 123/46 R (Continued)

FOREIGN PATENT DOCUMENTS

WO 2007048006 A2 4/2007
WO WO 2007048006 A2 * 4/2007 ..... B25C 1/08
WO 2008118838 A1 10/2008

OTHER PUBLICATIONS

ISR and WO for PCT/US2013/077833 dated May 30, 2014.

*Primary Examiner* — Chelsea E Stinson
(74) *Attorney, Agent, or Firm* — Thompson Hine LLP

(57) ABSTRACT

A gas fastening tool comprising an internal combustion engine including one combustion chamber, fuel injection means to inject fuel into the chamber and air injection means to inject air into the chamber, firing means for an air-fuel mixture within the chamber, reception means to receive a fastening element, one cylinder communicating with the chamber, forming together a combustion gas propagation pathway and wherein a piston is slidingly mounted so as to drive the fastening element, such tool being characterized in that it comprises a duct provided with a downstream input mouth and an upstream output mouth on the gas pathway, the piston stroke in the cylinder extending between the two duct mouths.

3 Claims, 1 Drawing Sheet

(58) Field of Classification Search
USPC ..... 227/9
See application file for complete search history.

(56) References Cited

U.S. PATENT DOCUMENTS

| | | | | |
|---|---|---|---|---|
| 8,205,582 | B2 * | 6/2012 | Adams | B25C 1/08 123/46 R |
| 2004/0231636 | A1 * | 11/2004 | Ricordi | B25C 1/08 123/262 |
| 2005/0120983 | A1 | 6/2005 | Adams | |
| 2008/0237295 | A1 | 10/2008 | Adams | |
| 2010/0258608 | A1 | 10/2010 | Porth et al. | |
| 2011/0005502 | A1 * | 1/2011 | Adams | B25C 1/08 123/559.1 |

* cited by examiner

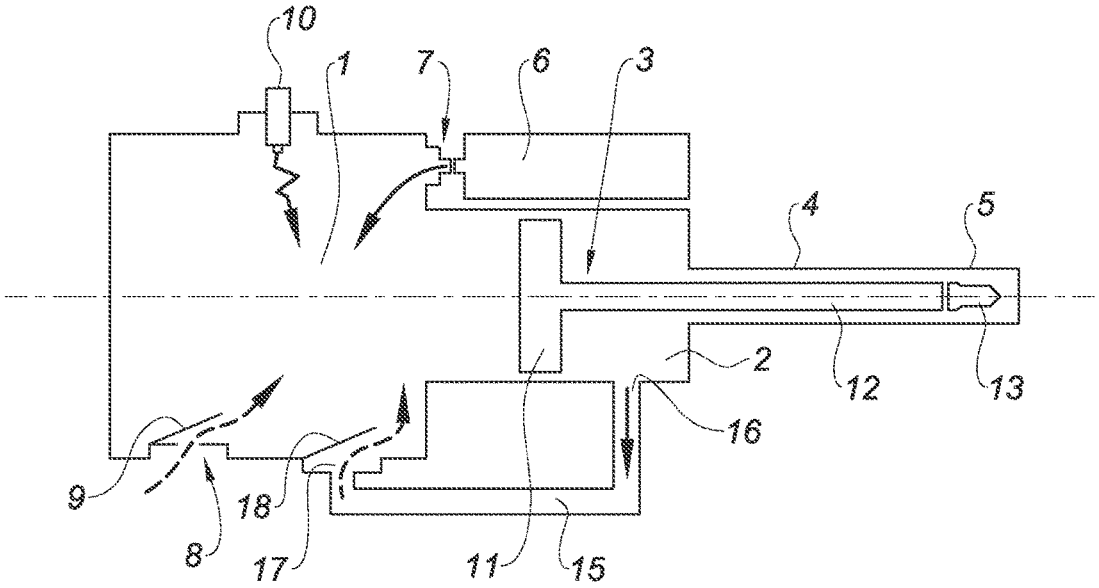
10
1
7
6
3
4
5
2
12
13
16
9
18
8
17
11
15

GAS FASTENING TOOL WITH RE-INJECTED AIR

RELATED APPLICATIONS

The present application is a National Phase of International Application Number PCT/US2013/077833 filed Dec. 26, 2013 and claims priority to French Application Number 1350361 filed Jan. 16, 2013.

The invention relates to bedding or fixing tools or so-called gas fasteners, i.e. the tools comprising an "internal combustion engine" operating through firing within a combustion chamber an air-fuel mixture, the fuel being injected into the chamber by an injection device from a fuel container, a so-called gas cartridge. Such tools are adapted to drive fastening elements into support materials so as to fasten parts thereto. The gas nailing machines are today quite common. A fuel for an internal combustion engine includes for example petrol, alcohol under a liquid form, and/or gas.

A gas tool thus comprises essentially, within a housing, one combustion chamber, where fuel and air can thus be injected, one cylinder, downstream from the chamber, where a driving piston is moved, after firing, under the action of combustion gases, so as to drive a fastening element into a support material.

Pollution problems are considered nowadays with a strong acuity. And combustion gases of the gas bedding tools are polluting gases. That is why the Applicant has tried to solve such emission problem for such gases.

Thus, the invention relates to a gas fastening tool comprising an internal combustion engine including one combustion chamber, fuel injection means to inject fuel into the chamber and air injection means to inject air into the chamber, firing means for an air-fuel mixture within the chamber, reception means to receive a fastening element, one cylinder communicating with the chamber, forming together a combustion gas propagation pathway and wherein a piston is slidingly mounted so as to drive the fastening element, such tool being characterized in that it comprises a duct provided with a downstream input mouth and an upstream output mouth on the gas pathway, the piston stroke in the cylinder extending between the two duct mouths.

In other words, on the pathway of the combustion gases, the downstream input mouth is arranged downstream from the piston, while the upstream output mouth is upstream.

Thus, the fresh air that is with the cylinder under the piston, i.e. ahead the piston, during the piston stroke, is driven by it in the duct through the downstream input mouth to be re-injected upstream behind the piston, through the upstream output mouth.

Such fresh air re-injection, obviously being made after the mixture explosion within the chamber will nevertheless improve the completion of the combustion so as to make it more complete, thereby reducing the generation of polluting gases CO and $NO_x$.

The upstream output mouth can be arranged either in the cylinder or in the combustion chamber.

Advantageously, such upstream output mouth is provided with a flap.

The invention will be better comprised with the help of the following description of the tool in accordance with the invention, referring to the sole accompanying FIGURE representing it in a sectional view under a schematic form.

The gas fastening tool to be described comprises one combustion chamber 1, one cylinder 2, one piston 3, one gun 4 extended by a tip-guide 5.

The tool comprises a housing 6 to receive a fuel cartridge being able to communicate with the combustion chamber 1 through an injector 7 provided for injecting, within the chamber 1, fuel from a cartridge being located in the housing 6. The chamber 1 comprises an air intake 8 provided with a flap 9. A sparkling plug 10 is dipped inside the chamber to cause a firing of an air-fuel mixture.

The cylinder 2 communicates with the chamber 1 and both form a propagation pathway for the combustion gases so as to propel the piston 3 towards the tool front. The piston 3 comprises a head 11 and a rod 12. The piston head 11 slides within the cylinder 2 under the action of the combustion gases, whereas the piston rod 12 slides in the gun 4.

A fastening element 13 having been introduced into the tip-guide 5, the piston rod 12, under the action of the propulsion gases, will drive the fastening element 13 into a support material.

The tool, as just described, is perfectly known from the man skilled in the art and does not need to be known anymore.

The tool according to the invention is distinct from those of the prior art with a duct 15 extending between a downstream input mouth 16 and an upstream output mouth 17 respectively arranged here at the front of the cylinder 2 and within the chamber 1. The upstream output mouth 17 is provided with a flap 18.

The input mouth 16 is located downstream from the piston head 11 and the upstream output mouth 17 upstream, both mouths being thus located on the combustion gas pathway. The stroke of the piston head 11 extends between the two mouths 17, 16. Thus, during the stroke of the piston 3 under the action of the combustion gases, after firing and explosion of the mixture, the fresh air being located under the piston head 11 is driven by such head into the duct 15 through the mouth 16 to be recovered in the chamber 12 by the mouth 17. Such fresh air will improve the completion of the combustion to make it more complete, thereby reducing the generation of polluting gases.

It should be noticed that the tool being just described could be equipped with a fan within the combustion chamber. It is a conventional arrangement for gas fastening tools.

The invention claimed is:

1. A gas fastening tool, comprising:

an internal combustion engine including one combustion chamber, fuel injection means to inject fuel into the combustion chamber, air injection means to inject air into the combustion chamber, firing means for an air-fuel mixture within the combustion chamber, reception means to receive a fastening element, one cylinder communicating with the combustion chamber, forming together a combustion gas propagation pathway, a piston slidingly mounted so as to drive the fastening element, the piston including a head, a duct provided with a downstream input mouth and an upstream output mouth on the gas pathway, wherein said duct is independent of both said air injection means and said fuel injection means and the downstream input mouth and the upstream output mouth are positioned such that, after firing and explosion of said air-fuel mixture within the combustion chamber, a combustion within the combustion chamber causes movement of the piston toward the reception means in order to drive the fastening element, and the movement of the piston causes fresh air located in the cylinder between the head of the piston and the reception means to be driven into the downstream input mouth, along the duct, out of the upstream output mouth and into the combustion chamber for providing additional fresh air to the combustion chamber to aid in completion of the combustion in the combustion chamber.

2. A gas fastening tool, comprising:

a reception area configured to receive a fastening element;

an internal combustion engine including one combustion chamber;

one cylinder communicating with the chamber;

a piston slidingly mounted for movement along the cylinder so as to drive the fastening element, the piston including a piston head with a first side facing the combustion chamber and a second side facing an end of the cylinder that is disposed toward the reception area;

a fuel injector configured to inject a fuel into the combustion chamber;

an air intake configured to deliver air into the combustion chamber for mixing with the fuel;

an igniter to fire the air-fuel mixture within the chamber; and a duct provided with an input mouth and an output mouth, the input mouth located along the cylinder toward the end of the cylinder, the output mouth in fluid communication with the combustion chamber and spaced and separate from both the air intake and the fuel injector, wherein the input mouth and the output mouth of the duct are positioned such that, after firing and explosion of said air-fuel mixture within the combustion chamber, a combustion within the combustion chamber causes movement of the piston head toward the reception area in order to drive the fastening element, and the movement of the piston causes fresh air located in the cylinder between the second side of the piston head and the end of the cylinder to be driven into the input mouth, along the duct, out of the output mouth and into the combustion chamber as an unobstructed flow for providing additional fresh air to the combustion chamber to aid in completion of the combustion within the combustion chamber.

3. A gas fastening tool, comprising:

a reception area configured to receive a fastening element;

an internal combustion engine including one combustion chamber;

one cylinder communicating with the chamber;

a piston slidingly mounted for movement along the cylinder so as to drive the fastening element, the piston including a piston head with a first side facing the combustion chamber and a second side facing an end of the cylinder that is disposed toward the reception area;

a fuel injector configured to inject a fuel into the combustion chamber;

an air intake configured to deliver air into the combustion chamber for mixing with the fuel;

an igniter to fire the air-fuel mixture within the chamber; and a duct having an input mouth and an output mouth, the input mouth located along the cylinder toward the end of the cylinder, the output mouth in fluid communication with the combustion chamber, wherein the duct is separate from both the air intake and the fuel injector and defines an unobstructed passage to permit free flow from the input mouth to the output mouth, wherein the input mouth and the output mouth of the duct are positioned such that, after firing and explosion of said air-fuel mixture within the combustion chamber, a combustion within the combustion chamber causes movement of the piston head toward the reception area in order to drive the fastening element, and the movement of the piston causes fresh air located in the cylinder between the second side of the piston head and the end of the cylinder to be driven into the input mouth, along the duct, out of the output mouth and into the combustion chamber as an unobstructed flow for providing additional fresh air to the combustion chamber to aid in completion of the combustion within the combustion chamber.

* * * * *